US005964686A

United States Patent [19]

Bidlack et al.

[11] Patent Number: 5,964,686

[45] **Date of Patent: *Oct. 12, 1999**

[54] METHOD FOR FORMING SLOTTED AND CREASED BOX BLANKS

[75] Inventors: Jerald D. Bidlack, East Aurora; Igor Shmelkin, East Amherst, both of N.Y.

[73] Assignee: Griffin Automation, Inc., West Seneca, N.Y.

[ * ] Notice: This patent is subject to a terminal disclaimer.

[21] Appl. No.: 08/965,787

[22] Filed: Nov. 7, 1997

[51] Int. Cl.[6] ..... B31B 1/25

[52] U.S. Cl. ..... 493/59; 493/60; 493/63; 493/65; 493/160

[58] Field of Search ..... 493/59, 60, 63, 493/82, 83, 86, 61, 65, 160, 342, 355, 354, 396, 404, 363, 364, 370, 371, 372, 373; 83/681, 40, 246

[56] References Cited

U.S. PATENT DOCUMENTS

| | | | |
|---|---|---|---|
| 3,308,723 | 3/1967 | Bergh, Jr. | 493/354 |
| 3,786,708 | 1/1974 | Mumper | 493/372 |
| 3,943,809 | 3/1976 | Schopee | 493/370 |
| 4,030,724 | 6/1977 | Quinlan | 493/60 |
| 4,710,156 | 12/1987 | Vossen | 493/354 |
| 4,725,261 | 2/1988 | Millard et al. . | |
| 5,181,899 | 1/1993 | Hill et al. | 493/355 |
| 5,624,369 | 4/1997 | Bidlack et al. | 493/355 |

*Primary Examiner*—James F. Coan
*Assistant Examiner*—Gene L. Kim
*Attorney, Agent, or Firm*—Phillips, Lytle, Hitchcock, Blaine & Huber LLP

[57] ABSTRACT

The invention provides an improved method of forming one or more box blanks (20) from a generally-rectangular sheet of material, comprising the steps of: providing a frame (28) for supporting and guiding the sheet; placing a sheet of material on the frame; controllably moving the sheet in a longitudinal direction relative to the frame; providing at least one longitudinal score line (21) on the sheet as the sheet moves relative to the frame; punching a first hole in the sheet; cutting a first slot (23) in the sheet between one longitudinal edge thereof and the first hole; punching a second hole in the sheet at a position spaced transversely across from the first hole; cutting a second slot (23) in the sheet between the other longitudinal edge thereof and the second hole; providing a transverse score line (22) on the sheet between the first and second holes; punching longitudinal slots in the sheet to severe the flaps (24) from the glue tab (27); and cutting the sheet to the length required for the desired shape and dimensions of the box; thereby to provide a creased and slotted box blank.

5 Claims, 7 Drawing Sheets

METHOD FOR FORMING SLOTTED AND CREASED BOX BLANKS

FIELD OF THE INVENTION

This invention relates generally to the field of box-forming machines, and, more particularly, to an improved method for forming slotted and creased box blanks from generally-rectangular sheets of corrugated cardboard material.

BACKGROUND ART

Cardboard boxes are a convenient form of packaging. Because of this, such boxes abound in a myriad of different shapes, sizes and configurations. However, their manufacture and assembly is accompanied by certain problems. For example, a particular business may have need of different sizes of boxes, and it may have to provide these in various quantities. One could, of course, simply purchase the assembled boxes from a suitable source. However, each assembled box occupies a volume. This volume, multiplied by the number of assembled boxes that must be stored, may require a substantial space.

Another solution would be to simply purchase quantities of pre-formed planar box blanks that could be selectively assembled as needed. While these blanks would occupy less volume than the assembled three-dimensional boxes, the business would still have to inventory an adequate number of blanks of the desired sizes. The attendant problems are immediately foreseeable; the desired box may not be in inventory when needed, or it may be damaged, or it may be difficult to find, and so on.

Because of these problems, it would be desirable for some businesses to have the in-house capability of creating various sizes and configurations of creased and scored box blanks from rectangular sheets of cardboard. Thus, only rectangular sheets of cardboard need by inventoried. These can be cut to size, and slotted and creased to form appropriately-sized and properly-configured box blanks, as needed. These blanks can then be folded and glued, taped or stapled to form three-dimensional boxes when required. See U.S. Pat. No. 5,624,369.

However, the present state of the art does not appear to provide a method for forming such blanks in a complete and final form. First, blanks formed according to the aforesaid '369 patent have two superfluous flaps which must be manually removed at a later stage. This results in additional cost and delay before the box can be assembled. In addition, the manual removal of these flaps may detract from the appearance of the blank. Therefore, it would be desirable to create high quality blanks that are ready to be formed into three-dimensional boxes without further cost or delay.

Second, the present state of the art requires that the rectangular sheets of material used to form the box blanks be cut, in a separate stage, to the proper dimensions for the desired shape. This also results in additional cost and delay. Therefore, it would be desirable to form complete box blanks from sheets that are physically larger than the minimum dimensions needed to form the desired shape. It would also be desirable to be able to form numerous box blanks from one long sheet or roll of material.

The present invention would allow businesses to be able to form complete blanks in a more cost-effective and less labor-intensive manner.

DISCLOSURE OF THE INVENTION

With parenthetical reference to the corresponding parts, portions or surfaces of the disclosed embodiment, merely for purposes of illustration and not by way of limitation, the present invention broadly provides an improved method for selectively forming slotted and scored box blanks from rectangular sheets of material, such as corrugated cardboard and the like.

This method is typically performed by an apparatus (26) for forming a box blank (20) from a generally-rectangular sheet of material, comprising: a frame (28) for supporting and guiding the sheet; advancement means (31) for controllably moving the sheet relative to the frame through the apparatus; guide means, including two guide rails (32), extending generally transversely of the sheet; a cutting head carriage (34) mounted on the guide rails for horizontal movement relative thereto; a cutting head servomotor (33) for moving the cutting head carriage relative to the guide rails; a cutting blade (35) mounted for horizontal movement with the carriage and operatively arranged to be rotated about an axis; a blade actuator (36) for selectively causing the blade to have a vertical component of movement relative to the carriage; a punch (38) mounted on the carriage and selectively operable to punch a hole or slot in the sheet; a transverse creasing roller (39) mounted on the carriage; and at least one longitudinal creasing roller (40) mounted on the carriage; whereby, as the sheet is moved relative to the frame, the transverse creasing roller may selectively crease or score the sheet in a transverse direction, each longitudinal creasing roller may selectively crease the sheet in a longitudinal direction, and the cutting blade may selectively cut slots in the sheet from both longitudinal edges.

The invention provides an improved method of forming one or more box blanks (20) from a generally-rectangular sheet of material, comprising the steps of: providing a frame (28) for supporting and guiding the sheet; placing a sheet of material on the frame; controllably moving the sheet in a longitudinal direction relative to the frame; providing at least one longitudinal score line (21) on the sheet as the sheet moves relative to the frame; punching a first hole in the sheet; cutting a first slot (23) in the sheet between one longitudinal edge thereof and the first hole; punching a second hole in the sheet at a position spaced transversely across from the first hole; cutting a second slot (23) in the sheet between the other longitudinal edge thereof and the second hole; providing a transverse score line (22) on the sheet between the first and second holes; punching longitudinal slots in the sheet to severe the flaps (24) from the glue tab (27); and cutting the sheet to the length required for the desired shape and dimensions of the box; thereby to provide a creased and slotted box blank.

Accordingly, the general object of this invention is to provide an improved method of forming a slotted and scored box blank.

These and other objects and advantages will become apparent from the foregoing and ongoing written specification, the drawings and the appended claims.

DESCRIPTION OF THE PREFERRED EMBODIMENTS

Figure 2:
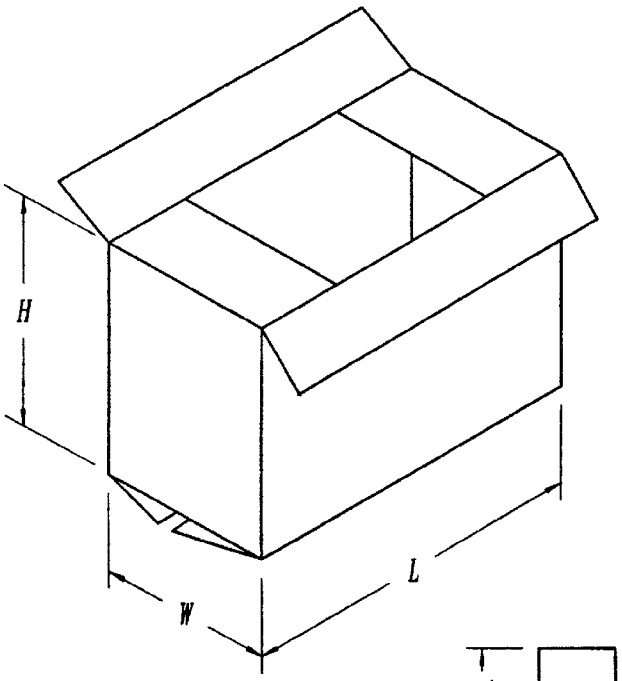
FIG. 2 is a perspective view of a simple rectangular box formed by assembling the blank shown in FIG. 1.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 1:
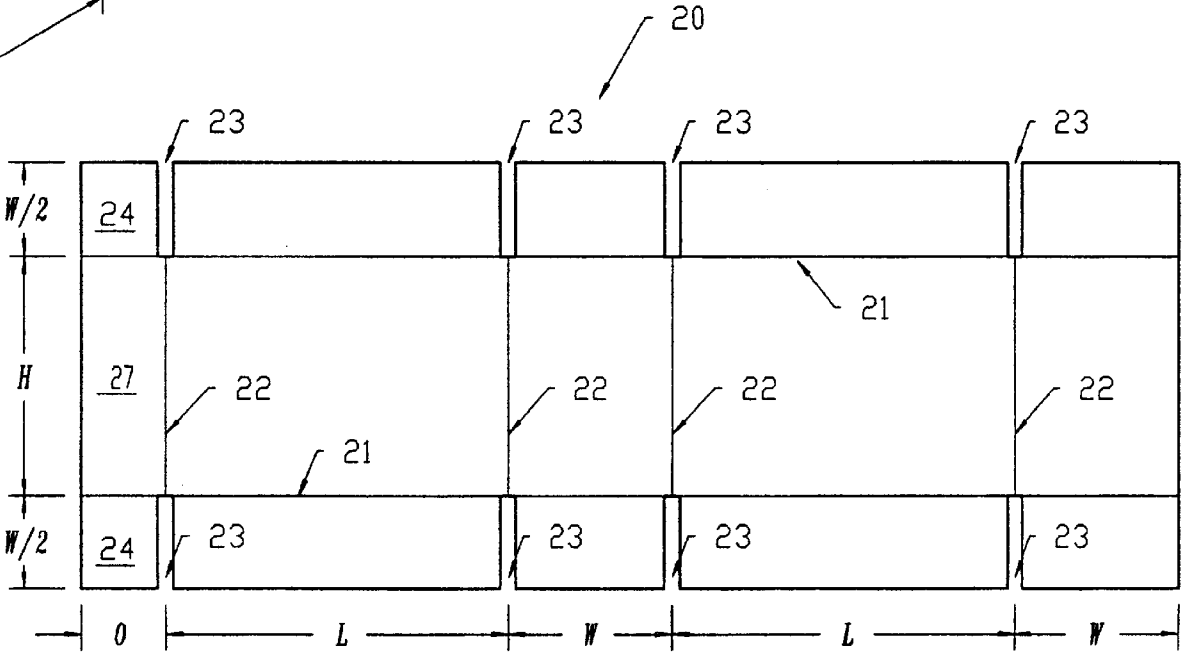
FIG. 1 is a plan view of a slotted and scored rectangular box blank prior to assembly and formation of a three-dimensional box.
Figure 3:
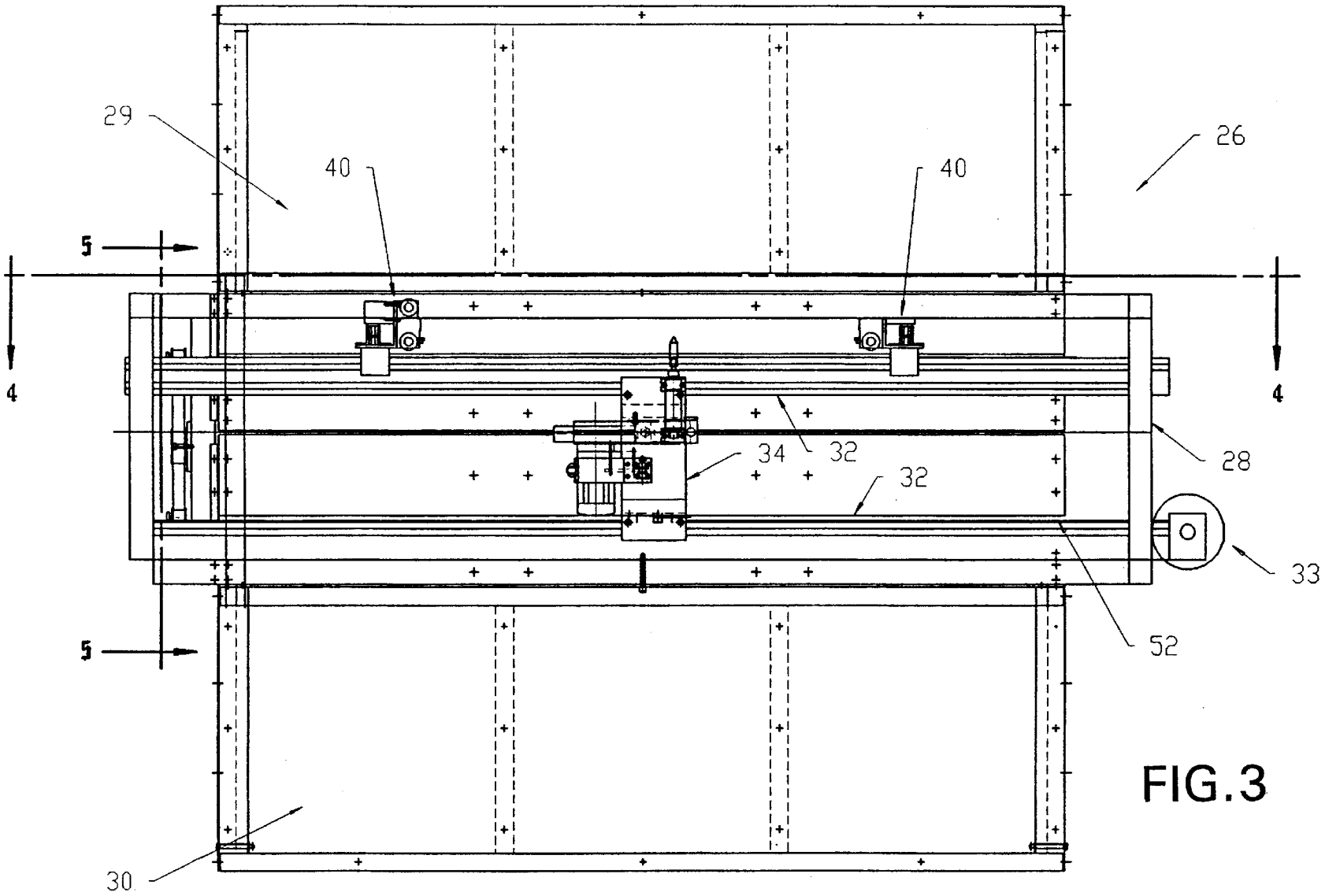
FIG. 3 is a top plan view of the improved apparatus.

Turning now to the drawings, and, more particularly to FIG. 1 thereof, a horizontally-elongated generally-rectangular planar box blank is generally indicated at 20. This blank is depicted as having two transversely-spaced longitudinal score lines or creases, severally indicated at 21; a plurality of longitudinally-spaced transverse score lines or creases, severally indicated at 22, which severally bisect slots, severally indicated at 23, cut into the blank from its two longitudinal edges. Blank 20 is depicted as having a width of H+W, and as having a length of 2L+2W+O, where O is the overlap allowance for gluing. The dimensions of the various flaps and tabs are depicted in the drawing. The two leftwardmost flaps are severally indicated at 24, and the leftwardmost glue tab is indicated at 27. The nominal dimensions may be increased slightly to account for thickness and folding.

The blank shown in FIG. 1 is then folded about in its score lines, to form the three-dimensional box 25 shown in FIG. 2. When so assembled, the box will have a length L, a width W, and a height H. The various tabs defined between the slots and score lines are folded in the well known manner, and are suitably secured in position by means of glue, tape, stables or the like.

The present invention provides improved method for forming box blanks, such as representatively indicated at 20 in FIG. 1, from a generally-rectangular sheet of material. As best shown in FIGS. 3–6, this method is typically performed by an apparatus, of which a presently-preferred form is generally indicated at 26, which broadly includes: a frame of 28 having infeed and outfeed horizontal table portions 29, 30, respectively, for supporting and guiding the sheet; advancement means 31 for controllably moving the sheet relative to the frame through the apparatus; guide rails 32 extending generally transversely of the sheet; a cutting head servomotor 33 for selectively moving the cutting head carriage relative to the guide rails; a cutting head carriage 34 mounted on the guide rails for relative movement therealong; a rotatable cutting blade 35 mounted for translational movement with the carriage and operatively arranged to be rotated about an axis; a blade actuator 36 (FIG. 6) for selectively causing the blade to have a vertical component of movement relative to the carriage; a punch 38 (FIG. 6) mounted on the carriage and selectively operable to punch a hole or slot in the sheet; a transverse creasing roller 39 (FIG. 6) mounted on the carriage; and longitudinal creasing rollers, severally indicated at 40, adjustably mounted on the guide rails; whereby, as the sheet is moved relative to the frame, the transverse creasing roller may selectively crease or score the sheet in a transverse direction, each longitudinal creasing roller may selectively crease the sheet in a longitudinal direction, and the cutting blade may selectively cut transverse slots in the sheet from both longitudinal edges.

Figure 4:
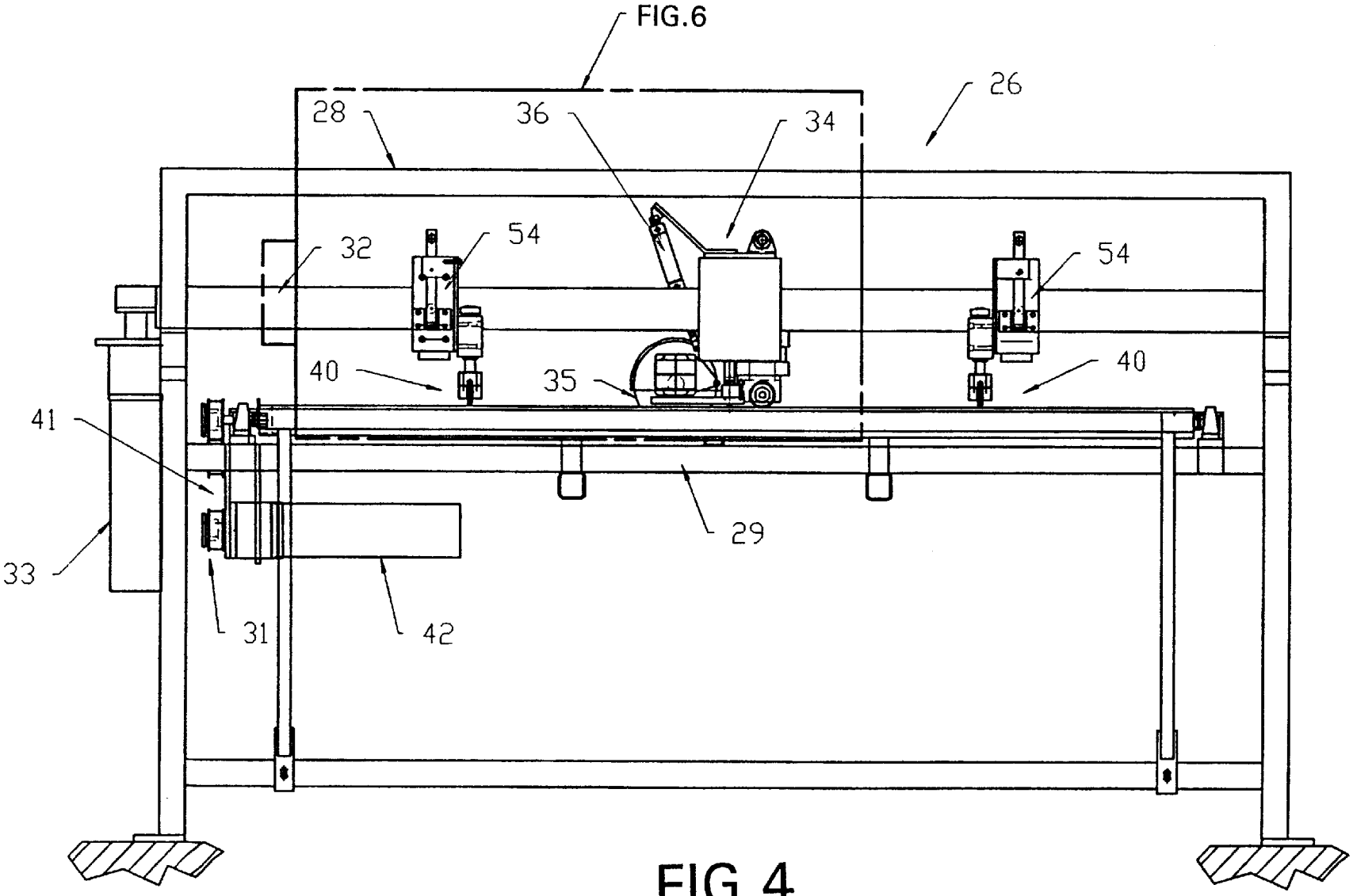
FIG. 4 is a fragmentary vertical sectional view thereof, taken generally on line 4—4 of FIG. 3.
Figure 5:
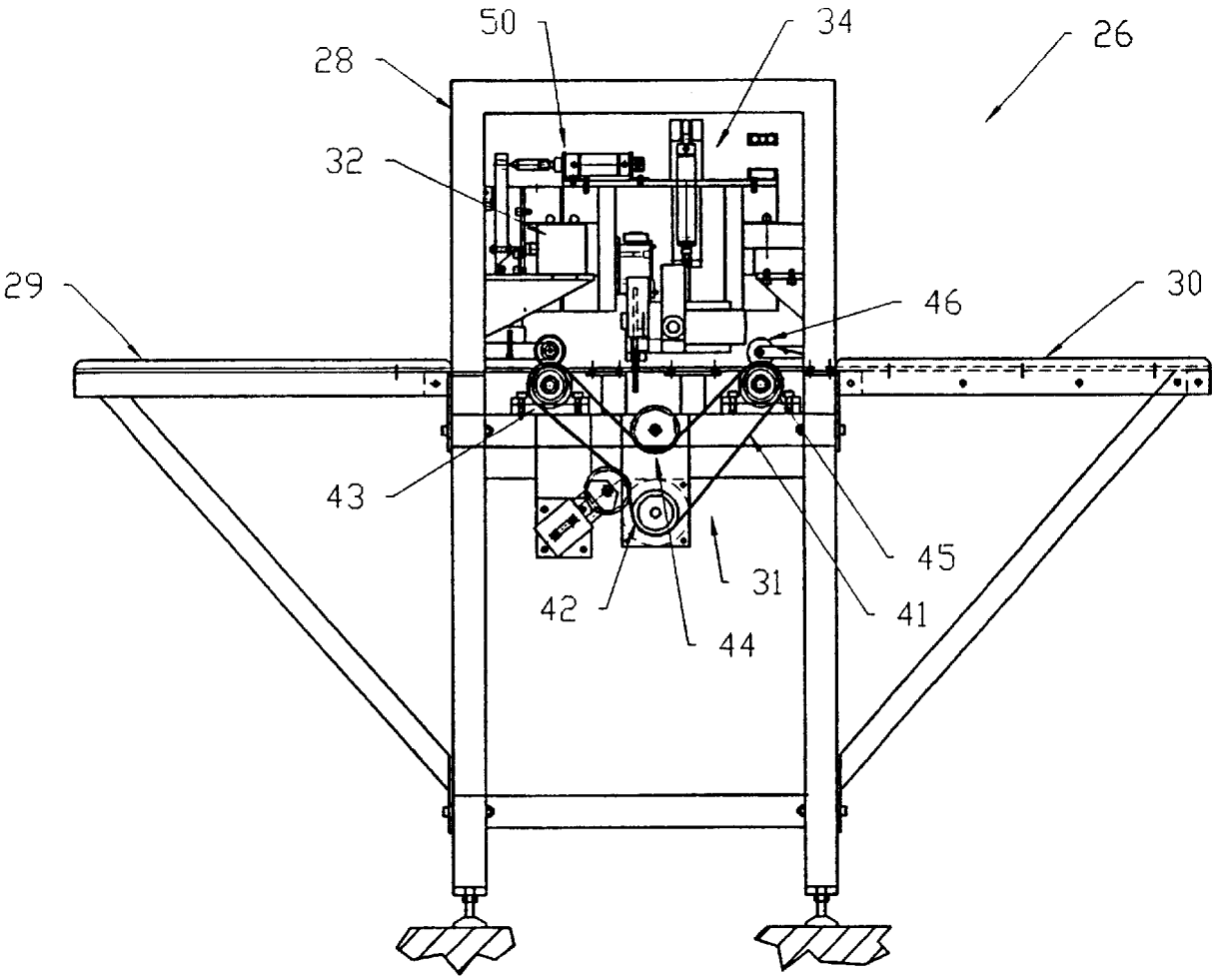
FIG. 5 is a fragmentary transverse vertical sectional view thereof, taken generally on line 5—5 of FIG. 3.

As best shown in FIGS. 4 and 5, the advancement means 31 includes an endless belt 41 driven by a motor 42. Belt 41 engages a motor-driven pulley, and an infeed pulley 43, an idler pulley, 44, and an outfeed pulley 45. A plurality of freely-rotatable wheels 46 are positioned immediately above infeed and outfeed pulleys such that when a sheet of material is interposed at the nip between the infeed pulley and the proximate rollers, the sheet will be grasped and will be advanced through the apparatus.

Each guide rail 32 is simply shown as being a horizontally-elongated tubular bar having a substantially-rectangular cross-section. The cutting head carriage 34 is moved along the guide rails by an endless belt 52 (FIG. 3) powered by the cutting head servomotor 33. The carriage 34 is mounted on the guide rails for translational movement therealong.

Figure 6:
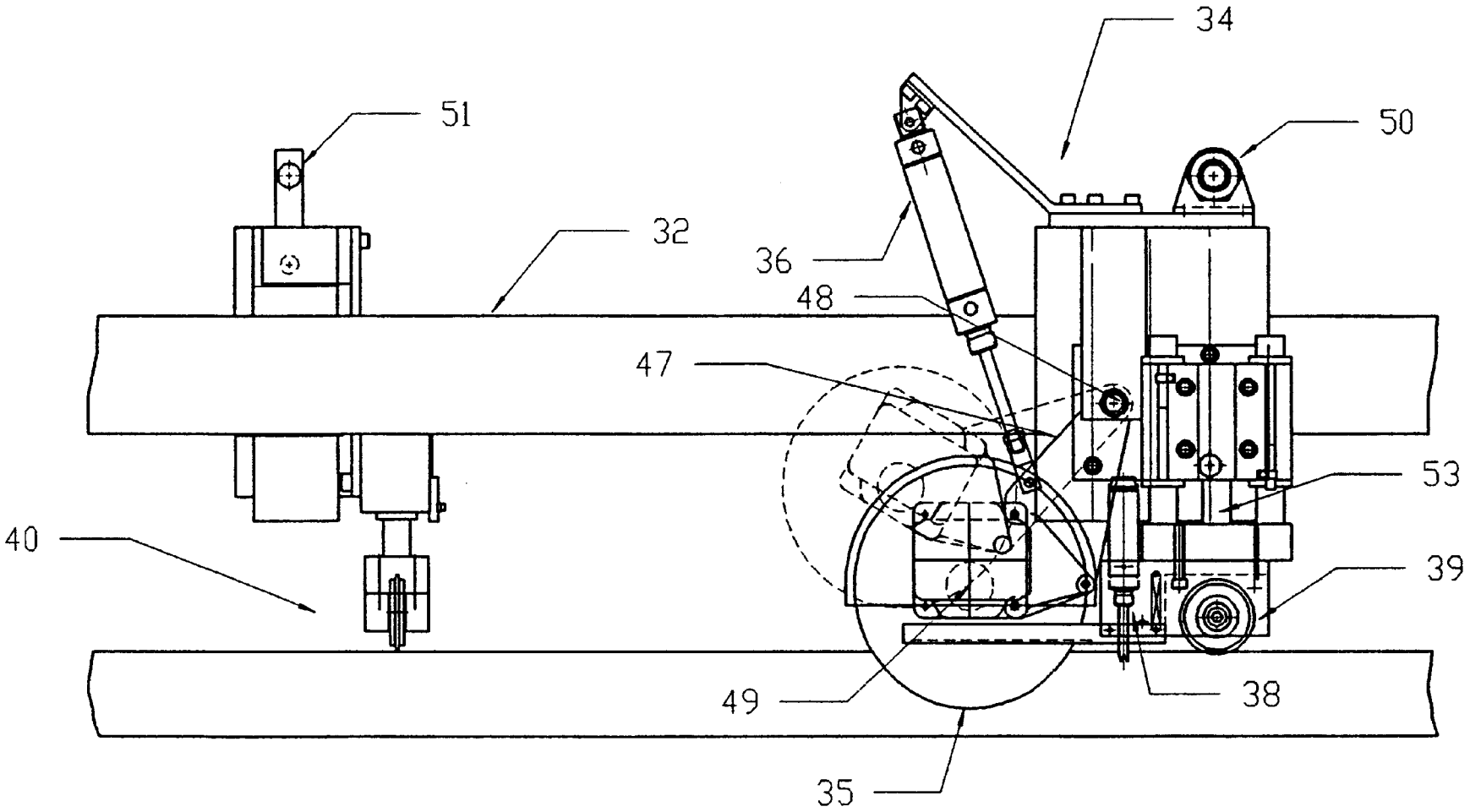
FIG. 6 is an enlarged fragmentary view thereof, showing the carriage and cutter in side elevation, this view being taken within the indicated lines in FIG. 4.

As shown in FIG. 6, the cutting blade is mounted on an arm 47 which, in turn, is mounted for pivotal movement about axis 48. The blade is mounted at the other end of the arm for powered rotational movement about axis 49. The blade actuator 36 acts between the cutting head carriage and arm 47 to selectively vary the vertical position of the cutting blade relative to the blank. The carriage also supports the punch 38, which may be selectively operated to punch a hole or slot in the cardboard sheet. The punch may be of any shape: circular, rectangular, square, a knife edge, etc. The transverse creasing roller 39 is mounted directly on the carriage for movement therewith. The creasing roller may be raised and lowered relative to the sheet by actuator 53.

The longitudinal creasing rollers 40 are mounted on the inboard guide rail 32, which is arranged generally parallel to the carriage. To this end, an actuator 50 is mounted on the carriage for selective engagement with these longitudinal creasing rollers. More particularly, actuator 50 has a conical end portion which may be selectively extended and retracted relative to the creasing rollers. In this regard, the actuator 50 may be extended such that its conical tip selectively engages hole 51 in each creasing roller mechanism. Such extension may displace the member in which hole 51 is provided to selectively disengage a brake such that the carriage and longitudinal creasing roller may thereafter be moved together as a unit from one location to another. When at the desired location, actuator 50 is retracted to allow the brake to reengage such that the longitudinal creasing roller will thereafter be held at the desired position relative to the frame. Thus, the carriage includes translation means, such as actuator 50, for selectively moving each longitudinal creasing roller to a desired position relative to the frame.

To form a box shown in FIG. 2, a rectangular blank of nominal width H+W and length 2L+2W+O, must be creased in six places, slotted in eight places, as shown in FIG. 1, the overlap flaps 24 must be removed, and the sheet must be cut transversely to the proper length 2L+2W+O. Other styles of boxes may have more or less slots and creases. After the blank is slotted, creased, the overlap flaps removed, and the sheet cut to the proper length, the three-dimensional box is typically formed by folding along the creases and by gluing the remaining portion of the overlap flap, otherwise referred to as the glue tab 27, and the bottom flaps along their required surfaces. The folding and gluing operations are not performed by the inventive apparatus.

Figure 9:
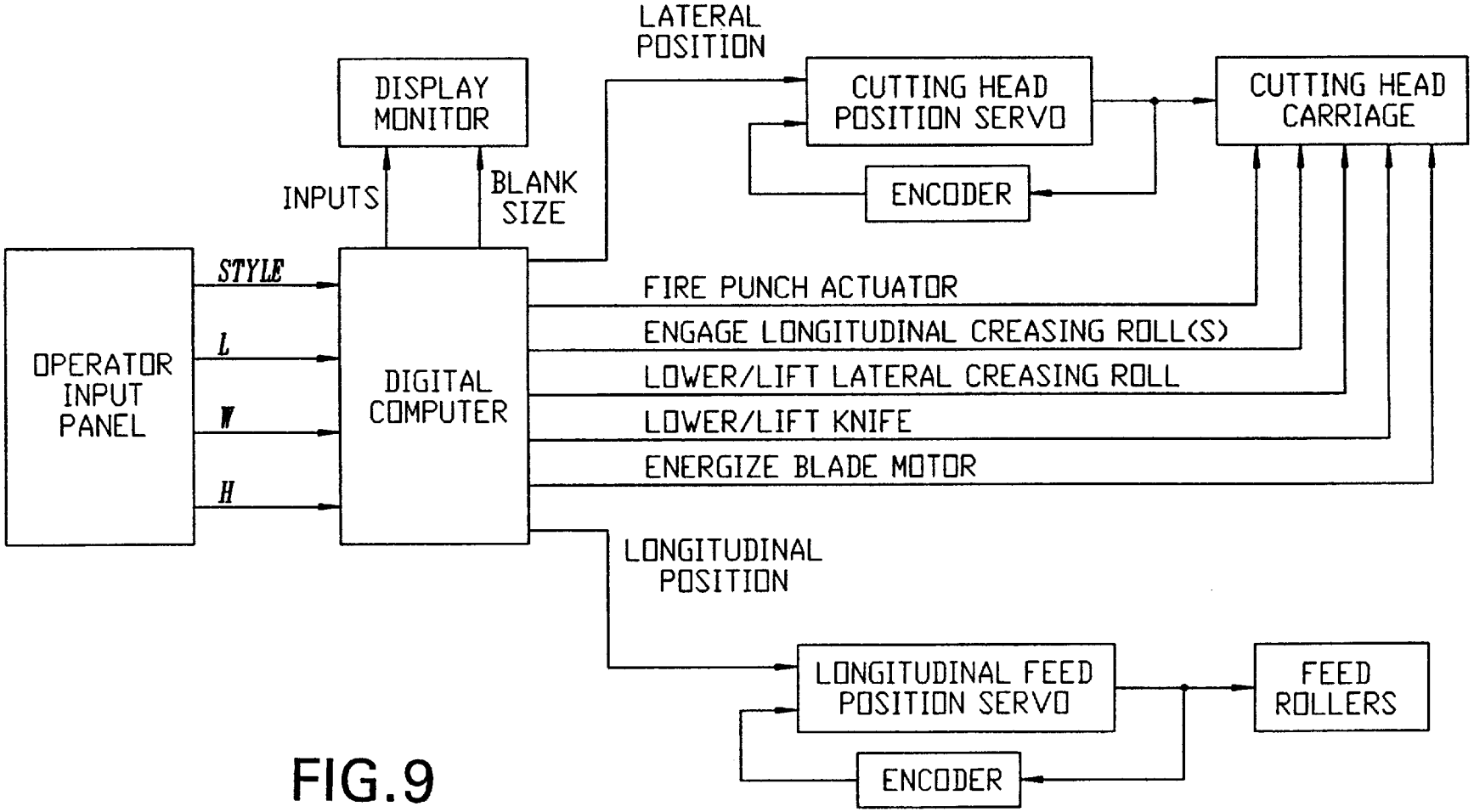
FIG. 9 is a simplified computer control block diagram.

The apparatus is controlled by a computer, shown in simplified and schematic form in FIG. 9, that informs the operator of the required blank dimensions to achieve a defined set of box dimensions. The operator inputs the desired style and dimensions (i.e., L, W and H). The exact blank dimensions determined by the computer include increments to each desired finished box dimension to account for sheet thickness and folding.

A typical machine cycle begins with the operator entering the desired box style and dimensions into the computer. This is done only once per box style and size. The computer displays the blank width and length needed to form the desired shape on a suitable monitor. The sheets are cut elsewhere to the displayed width and to a length equal to or greater than the displayed length, for example, on a slitting machine. Once the sheets are cut to these dimensions, the operator simply feeds them into the machine one at a time. The machine accepts the proffered blank, and provides commands to the various devices automatically. These commands include "fire punch actuator", "engage longitudinal creasing roll(s)", "lower/lift lateral creasing roll", "lower/lift knife" and "energize blade motor" commands that are supplied to the cutting head carriage. The desired lateral position of the cutting head is supplied to a cutting head position servo, having an encoder loop closed thereabout, that is used to position the cutting head carriage. The desired longitudinal position is supplied to a longitudinal feed position servo, having an encoder loop closed thereabout, that is used to control the operation of the feed rollers. The operational sequence is as follows:

(1) For the first blank only, the longitudinal creasing rollers are lifted by actuators 54, and the carriage is moved to severally position each of the two longitudinal creasing rollers laterally relative to the blank. As indicated above, the carriage is moved along the inboard guide rail to the position of a longitudinal creasing roller. Actuator 50 is then operated to engage the carriage with the creasing roller, and to disengage the creasing roller brake. The carriage is then moved to the desired location, and actuator 50 is then disengaged. Viewing the lower right hand corner of the blank in FIG. 1 as the origin, the longitudinal creasing roller would be moved to positions W/2 and H+W/2, respectively. Once actuator 50 is retracted, the automatic locking mechanism securely holds each longitudinal creasing roller in its new location. At this point, the longitudinal creasing rollers are lowered to engage the blank. They remain lowered until the machine is reset for different blank dimensions.

(2) The operator then presents the sheets correctly-cut to the proper width to the infeed table. These are grabbed between the nip of the infeed roller and the adjacent idlers. The advancement means then grabs the sheet, and advances it through the machine, stopping at every position where lateral slots and creases are required. For the blank shown in FIG. 1, the blank will be stopped four times at longitudinal positions W, W+L, 2W+L, and 2W+2L, respectively.

(3) At each longitudinal stopping point, the carriage provides the lateral creases and cuts the desired slots by a series of operations as described below.

Figure 7:
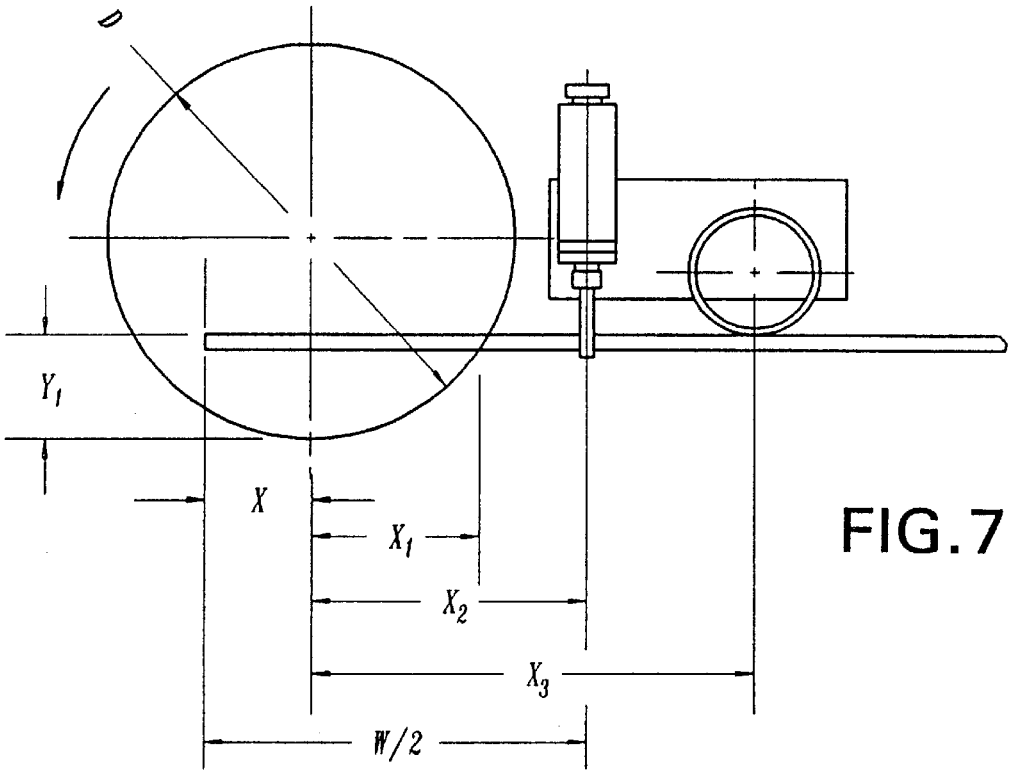
FIG. 7 is a schematic of the various dimensional parameters involved in cutting the proximate slot and punching the proximate flap.

(a) The knife and lateral creasing roller are first lowered to engage the blank. The knife is caused to rotate about its axis 49, and the rotating knife and lateral creasing roll are advanced to begin cutting the first slot. In FIG. 7, $X \leqq W/2-X_3$ is required so that creasing begins at or before the first slot root position.

(b) The carriage is then advanced laterally while cutting the slot. The carriage is moved to a position and stopped such that the punch is positioned immediately above the root of the first slot at $X=W/2-X_2$, as shown in FIG. 7.

(c) The punch is operated to punch a hole or slot at the root location of the first slot.

(d) The carriage is advanced so that the rotating knife blade cuts and removes all materials up to the first slot root at $X=W/2-X_1$.

(e) The blade actuator 36 is then operated to lift the knife blade above the surface of the blank, leaving the lateral creasing roller 39 in scoring contact with the blank.

Figure 8:
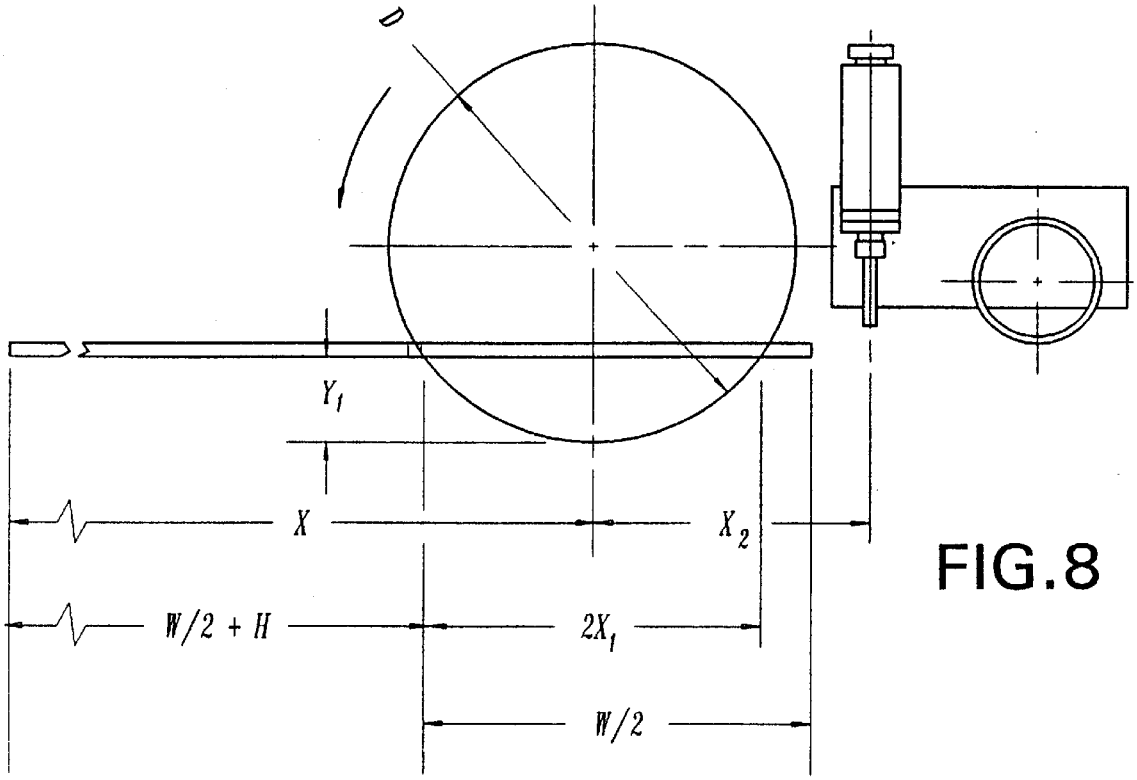
FIG. 8 is a schematic of the various dimensional parameters involved in cutting the distal slot and punching the distal flap.

(f) The carriage is advanced to position the punch at the root position of the distal slot (i.e., at $X=W/2+H-X_2$ in FIG. 8). During this translation, the lateral creasing roll 39 forms a lateral crease in the blank.

(g) The punch 39 is operated to punch a hole or slot at the second root location.

(h) The carriage is further advanced a distance $X_2$ over the second slot position such that by simply lowering the cutting blade, (i.e., a plunging cut), the blade will cut back to the root without further advancing the blade position (i.e., $X=W/2+H+X_1$), as shown in FIG. 8.

(i) If necessary, the carriage is advanced to cut the remainder of the second slot. When $X=W/2+H+X_1$, if $2X_1 \geqq W/2$, the slot is completed by simply lowering the knife with no further translational motion of the carriage relative to the guide rails. Alternatively, if $2X_1<W/2$, then the second slot is cut by first lowering the blade, and then moving the blade laterally until $X=W+H-X_1$.

(j) The lifting actuators 36, 53 are then operated to lift the knife blade and to elevate the lateral blade creasing roller, and the carriage is returned to its home position (i.e., $X \leqq W/2-X_3$).

(4) After completing the first crease and the provision of the first slots, the machine automatically advances the blank longitudinally to the next slot position, and repeats the lateral movements required to generate a second crease and second pair of slots. This process is continued until all slots and creases are formed.

(5) After completing the last slot, the flaps 24 are removed by a series of operations as described below.

(a) The machine advances the blank a longitudinal distance equal to, or less than, the longitudinal width of the punch.

(b) The carriage is moved to position the punch longitudinally parallel with the root of the proximate slot (i.e., at $X=W/2-X_2$ in FIG. 7).

(c) The punch is operated to punch a hole or slot.

(d) The carriage is further moved to position the punch longitudinally parallel with the root of the distal slot (i.e., at $X=W/2+H-X_2$, in FIG. 8).

(e) The punch is operated to punch a hole or slot.

(f) The machine advances the blank a longitudinal distance equal to, or less than, the longitudinal width of the punch.

(g) The punch is again operated to punch a hole or slot.

(h) The carriage is moved to position the punch longitudinally parallel with the root of the proximate slot (i.e., at $X=W/2-X_2$ in FIG. 7).

(i) The punch is operated to punch a hole or slot.

(6) The process in paragraph (5) is repeated until flaps 24 are removed from the glue tab 27 (i.e., a longitudinal slot it punched a distance O in FIG. 1).

(7) Viewing the lower right hand corner of the blank in FIG. 1 as the origin, once the flaps have been removed from the glue tab, the machine has advanced the blank such that the carriage and rotating knife blade 35 are positioned at 2L+2W+O.

(8) The knife is lowered to engage the blank, the knife is caused to rotate about its axis 49, and the rotating knife is advanced to cut the sheet transversely at 2L+2W+O from one longitudinal edge to the other, (9) The finished blank is fed out of the machine and the processes in paragraphs (3) through (8) may be repeated. The process should be repeated when, for example, the blanks are being formed from a long sheet or roll of material.

All machine motions (i.e., positions, velocities, accelerations) are automatically are automatically controlled by servomechanisms employing the longitudinal feed servomotor 42 and the carriage feed servomotor 33. All displacement, velocity and acceleration commands are generated in the computer from operator input information. The computer also controls the machine cycle automatically.

In use, the apparatus provides an improved method of forming one or more box blank (20) from a generally-rectangular sheet of material, which method includes the steps of providing a frame (28) for supporting and guiding the sheet; placing a sheet of material on the frame; controllably moving the sheet in a longitudinal direction relative to the frame; providing at least one longitudinal score line (21) on the sheet as the sheet moves relative to the frame, punching a first hole in the sheet; cutting a first slot (23) in the sheet between one longitudinal edge thereof and the first hole; punching a second hole in the sheet at a location spaced transversely across from the first hole; cutting a second slot (23) in the sheet between the other longitudinal edge thereof and the second hole; providing a transverse score line (22) on the sheet between the first and second hole; punching longitudinal slots in the sheet to severe the flaps (24) from the glue tab (27); and cutting the sheet to the length required for the desired shape and dimensions of the box; thereby to provide a scored and slotted box blank.

Modifications

The present invention contemplates that many changes and modifications may be made. For example, the apparatus could be provided with suitable cutting knives for cutting oversized rectangular sheets down to the correct width, prior to the operations described above. Secondly, the apparatus may be provided with automatic means for moving the longitudinal creasing rollers, and for resetting them automatically by mere disengagement of the actuator 50. Alternatively, these might possibly be set or adjusted manually. The advancing means may include the endless belt arrangement shown, or some other arrangement, as desired. The means or mechanism for moving the carriage along the guide rails may also be varied. The cutting blade may be a single blade having the desired curve, or may be in the form of two horizontally-spaced blades, as desired. The blade actuator form may also take many different and varied forms. The punch may be pneumatically or electrically driven or operated. The punch may be any shape, including a thin knife blade, and may thus produce a slot or hole of any shape. Also, there may be one or more longitudinal creasing rollers, as may be necessary.

The knife need not necessarily be of the single-thickness rotary type. In some applications, a double-bladed knife, with two thin blades spaced apart to form the slot width, may be used. A saw blade may be used instead of a rotating knife and punch. A fixed knife blade may also be used. An unpowered rotary blade could be used. Pre-creased blanks would eliminate the need for longitudinal creasing rolls. The creases could be formed using a form tool instead of a roller. The blanks need not necessarily be rectangular. Many box styles, other than the simple rectangular box shown in FIG. 2, are possible. The entire process is computer controlled. The operator specifies the blank size, and may choose whether or not to have the flaps 24 removed and, depending on the length of the sheet to be used, how many blanks to cut. The computer stores the style information, sets-up the machine, and controls the machine during the subsequent operations.

Therefore, while the presently-preferred form of the apparatus has been shown and described, and several modifications thereof discussed, persons skilled and desirable readily appreciate the various additional changes and modifications may be made without departing from the spirit of the invention.

What is claimed is:

1. The method of forming a scored and slotted box blank from a generally-rectangular sheet of material, comprising the steps of:

providing a frame for supporting and guiding said sheet;

placing a sheet of material on said frame, said sheet having first and second longitudinal edges;

providing guide means extending transverse to said longitudinal edges of said sheet;

providing a carriage mounted to said guide means for transverse movement along the guide means;

providing a transverse cutting means mounted to said carriage for transverse movement with said carriage to transversely cut across said sheet and form predetermined slots in said sheet;

providing punch means mounted to said carriage for selectively punching slots in said sheet;

controlling said transverse slot cutting means to transversely cut at least one predetermined slot in said sheet;

controlling said punch means to punch a first slot in said sheet at a transverse position;

controllably moving said sheet in a longitudinal direction relative to said frame;

controlling said punch means to punch a second slot longitudinally overlapping said first slot;

thereby to punch a longitudinal slot in said sheet greater than the longitudinal width of said punch.

2. The method as set forth in claim 1 and further comprising the steps of:

controlling said transverse slot cutting means to transversely cut and form predetermined slots in said sheet, said slots forming a tab, a first flap, and a second flap;

operating said punch means to punch a longitudinal cut in said sheet which severs said first flap from said tab;

operating said punch means to punch a longitudinal cut in said sheet which severs said second flap from said tab.

3. The method of forming a blank from a generally-rectangular sheet of material, comprising the steps of:

providing a frame for supporting and guiding said sheet;

placing a sheet of material on said frame, said sheet having first and second longitudinal edges;

providing guide means extending transverse to said longitudinal edges of said sheet;

providing a carriage mounted to said guide means for transverse movement along the guide means;

providing punch means mounted to said carriage for selectively punching a slot in said sheet;

providing a transverse cutting means mounted to said carriage for transverse movement with said carriage to transversely cut said sheet;

controlling said transverse cutting means to transversely cut at least one predetermined slot in said sheet;

controlling said punch means to punch a longitudinal slot in said sheet at a transverse position;

controllably moving said sheet in a longitudinal direction relative to said frame;

controlling said transverse cutting means to transversely cut across said sheet;

thereby to form a blank with a set longitudinal dimension.

4. The method as set forth in claim 1 and further comprising the step of:

controlling said transverse cutting means to transversely cut across said sheet.

5. The method as set forth in claim 2 and further comprising the step of:

controlling said transverse cutting means to transversely cut across said sheet.

* * * * *